US006840688B2

(12) United States Patent
Kurashina

(10) Patent No.: US 6,840,688 B2
(45) Date of Patent: Jan. 11, 2005

(54) METHOD OF PROCESSING CHARACTER IN TAPE PRINTER AS WELL AS TAPE PRINTER

(75) Inventor: Hiroyasu Kurashina, Matsumoto (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 55 days.

(21) Appl. No.: 10/412,618

(22) Filed: Apr. 11, 2003

(65) Prior Publication Data

US 2003/0218773 A1 Nov. 27, 2003

(30) Foreign Application Priority Data

Apr. 30, 2002 (JP) ..... 2002-128220

(51) Int. Cl.[7] ..... B41J 5/30

(52) U.S. Cl. ..... 400/68; 400/76; 400/615.2; 358/1.16

(58) Field of Search ..... 400/76, 70, 68, 400/61, 62, 611–620; 358/1.15–1.17, 1.9, 537, 538

(56) References Cited

U.S. PATENT DOCUMENTS 5,156,468 A * 10/1992 Uematsu ..... 400/68
5,360,277 A * 11/1994 Matsubara et al. ..... 400/68
5,478,155 A * 12/1995 Sasaki ..... 400/76
5,871,293 A * 2/1999 Kano ..... 400/615.2

FOREIGN PATENT DOCUMENTS

JP 06227052 A * 8/1994 ..... B41J/3/46

* cited by examiner

*Primary Examiner*—Minh Chau
(74) *Attorney, Agent, or Firm*—Hogan & Hartson, LLP

(57) ABSTRACT

In a method of processing a character in a tape printer, the tape printer has an editing storage area including an editing operation sub-area for editing an inputted character string and a registration sub-area for registering and saving a character string to be used later. The method is made up of a first step of securing a temporary area for temporarily storing a character string outside the editing storage area, a second step of storing a character string stored in the editing operation sub-area into the temporary area after the first step, a third step of storing a character string stored in the registration sub-area into the editing operation sub-area after the second step, a fourth step of storing the character string stored in the temporary area into the registration sub-area after the third step, and a fifth step of releasing the temporary area after the fourth step.

8 Claims, 9 Drawing Sheets

METHOD OF PROCESSING CHARACTER IN TAPE PRINTER AS WELL AS TAPE PRINTER

BACKGROUND OF THE INVENTION

1. Field of the Invention

The present invention relates to a method of processing a character in a printer capable of editing, registering and saving an inputted character string (or character sequence), as well as to a tape printer adopting the character processing method.

2. Description of the Related Art

A conventional tape printer includes an editing operation area for storing one of inputted text data (a character string) and performing an editing operation of the stored text data, and a registration area for storing about one to one hundred text data which are inputted for the purpose of future retrieval for editing or usage thereof, collectively referred to as an editing storage area.

Moreover, since text data editing is performed in the editing operation area, upon retrieving (editing) the text data stored in the registration area, the retrieved text data are overwritten (saved) in the editing operation area. For this reason, text data previously stored in the editing operation area, i.e. the text data in the process of editing, are deleted in the conventional tape printer. If a user wishes to use the text data in the process of editing afterwards, the user had to register and save the text data existing in the editing operation area into the registration area, and then retrieve the text data in the registration area again.

Furthermore, since the retrieved text data are overwritten in the editing operation area, a storage area for storing at least N+1 pieces of text data is required for processing N pieces of text data. For this reason, in order to process N pieces of text data, the conventional tape printer is provided with a storage area within the editing storage area which is for storing at least N+1 pieces of text data.

It is important to use the storage area more efficiently in the case of a tape printer having a very limitedly available storage area like ones which are not connected to external devices such as a personal computer. Specifically, in the case where the tape printer cannot secure a sufficient registration area so that the tape printer can only secure the storage area for registering and saving only one piece of the inputted text data, a new method of utilizing the storage area is required apart from the relevant method in the conventional tape printer. In this case, the tape printer is supposed to have the storage area which can store two pieces of text data in the combined use of the editing operation area and the registration area. However, in the conventional method of processing text data for a tape printer, when the user wishes to edit the text data stored in the registration area, the text data retrieved from the registration area are overwritten in the editing operation area, whereby the text data so far in the process of editing are deleted. Accordingly, the conventional method can practically deal with only one piece of the text data. In other words, if the conventional method of processing text data is used in the case where the tape printer can secure the storage area for registering and saving only one piece of the inputted text data, the method substantially degrades convenience of the user because the text data in process of editing are deleted every time when the user retrieves other text data registered and saved therein.

SUMMARY OF THE INVENTION

Therefore, it is an advantage of the present invention to provide a method of processing a character strong in a tape printer capable of efficiently using a storage area of a tape printer with a very limitedly available storage area by eliminating waste use of the storage area and capable of enhancing convenience and operability upon retrieving text data registered and saved therein, and to provide a tape printer adopting the method of processing a character.

According to one aspect of the present invention, there is provided a method of processing a character in a tape printer, the printer comprising an editing storage area including an editing operation sub-area for editing an inputted character string and a registration sub-area for registering and saving a character string to be used later. The method comprises: a first step of securing a temporary area for temporarily storing a character string outside the editing storage area; a second step of storing a character string stored in the editing operation sub-area into the temporary area after the first step; a third step of storing a character string stored in the registration sub-area into the editing operation sub-area after the second step; a fourth step of storing the character string stored in the temporary area into the registration sub-area after the third step; and a fifth step of releasing the temporary area after the fourth step.

According to another aspect of the present invention, there is provided a tape printer having an editing storage area including an editing operation sub-area for editing an inputted character string and a registration sub-area for registering and saving a character string to be used later. The tape printer comprises: means for securing a temporary area for temporarily storing a character string outside the editing storage area; means for storing a character string stored in the editing operation sub-area into the temporary area; means for storing a character string stored in the registration sub-area into the editing operation sub-area; means for storing the character string stored in the temporary area into the registration sub-area; and means for releasing the temporary area.

According to the above-described arrangements, in the case of storing the character string stored in the registration sub-area into the editing operation sub-area for editing the relevant character string, the character string stored in the editing operation sub-area is stored in the edited character string storing step (or stored by the edited character string storing means) into the temporary area which is secured in the temporary area securing step (or secured by the temporary area securing means), then the character string stored in the registration sub-area is stored into the editing operation sub-area in the registered character string storing step (or stored by the registered character string storing means), and then the character string stored in the temporary area can be stored into the registration sub-area in the character string registering step (or stored by the character string registering means). Therefore, it is possible to interchange the character string stored in the editing operation sub-area and the character string stored in the registration sub-area by using the temporary area. In other words, since the temporary area used temporarily as an editing storage area is secured outside the editing operation sub-area as a storage area for interchanging the character strings, it is possible to interchange the character strings stored in the editing operation sub-area and the character strings stored in the registration sub-area irrespective of the number of character strings that can be stored in the registration sub-area (the editing storage area).

Moreover, by securing the temporary area, which is the temporary editing storage area, outside the editing storage area, it is not necessary to secure a storage area within the editing storage area for interchanging the character string stored in the editing operation sub-area and the character string stored in the registration sub-area. Accordingly, it is possible to use the storage area efficiently. In other words, the storage area having capacity for storing N pieces of character strings can deal with N pieces of character strings and thus economize a space in the storage area equivalent to storage of one character string. In particular, a tape printer incorporating an integrated circuit has a limitedly available storage area, so that such a tape printer is often capable of storing only one character string in a registration sub-area thereof. In this case, a conventional tape printer can deal with only one character string practically. However, according to the present invention, it is possible to deal with two character strings by interchanging the character string stored in the registration sub-area and the character string stored in the editing operation sub-area. Therefore, convenience of a user is not degraded because it is not necessary to delete the character string stored in the editing operation sub-area every time when the user edits the character string stored in the registration sub-area.

Moreover, the character string stored in the registration sub-area and the character string stored in the editing operation sub-area are mutually interchangeable. Accordingly, it is possible to curtail a registering operation for registering and saving the character string in process of editing, which is stored in the editing operation sub-area, into the registration sub-area every time when the character string stored in the registration sub-area is used. In this way, operability of the user can be enhanced.

According to another aspect of the present invention, there is provided a method of processing a character in a tape printer, the printer comprising an editing storage area including an editing operation sub-area for editing an inputted character string and a registration sub-area for registering and saving a character string to be used later. The method comprises: a first step of securing a temporary area for temporarily storing a character string; a second step of storing a character string stored in the registration sub-area into the temporary area after the first step; a third step of storing a character string stored in the editing operation sub-area into the registration sub-area after the second step; a fourth step of storing the character string stored in the temporary area into the editing operation sub-area after the third step; and a fifth step of releasing the temporary area after the fourth step.

According to another aspect of this invention, there is provided a tape printer having an editing storage area including an editing operation sub-area for editing an inputted character string and a registration sub-area for registering and saving a character string to be used later. The tape printer comprises: means for securing a temporary area for temporarily storing a character string; means for storing a character string stored in the registration sub-area into the temporary area; means for storing a character string stored in the editing operation sub-area into the registration sub-area; means for storing the character string stored in the temporary area into the editing operation sub-area; and means for releasing the temporary area.

According to the above-described arrangements, it is possible to interchange the character string stored in the editing operation sub-area and the character string stored in the registration sub-area by use of the temporary area. Therefore, it is not necessary to perform a registering and saving operation of the character string stored in the editing operation subarea every time when the character string stored in the registration sub-area is edited. Moreover, in the case where the tape printer has only a limitedly available storage area so that the tape printer can register and save only one character string in the registration sub-area, the character string stored in the editing operation sub-area is not deleted every time when the character string stored in the registration sub-area is edited because the character string stored in the editing operation sub-area and the character string stored in the registration sub-area are mutually interchangeable. Accordingly, operability of the user is not degraded. Further, since the character string stored in the registration sub-area is temporarily stored in the temporary area being the temporary storage area outside the editing storage area, it is not necessary to secure a storage area within the editing storage area for interchanging the character string stored in the editing operation sub-area and the character string stored in the registration sub-area. In this way, it is possible to economize the storage area.

In any of these cases, it is preferable that the temporary area is secured from a printing storage area which is a storage area for printing the character strings.

According to this arrangement, it is possible to utilize the storage area efficiently by using the printing storage area, which is the storage area not used in the course of editing the character string, as the temporary area.

According to still another aspect of the present invention, there is provided a method of processing a character string in a tape printer, the tape printer comprising a storage area for storing a character string, in which editing identification information is attached to an inputted character string when the character string is in a process of editing, and saving identification information is attached to the character string when the character string is in a process of registering and saving. The method comprises the steps of: rewriting the editing identification information attached to the character string into the saving identification information; and rewriting the saving identification information attached to the character string into the editing identification information.

According to still further aspect of the present invention, there is provided a tape printer having a storage area for storing a character string, in which editing identification information is attached to an inputted character string when the character string is in a process of editing, and saving identification information is attached to the character string when the character string is in a process of registering and saving. The tape printer comprises: means for rewriting the editing identification information attached to the character string into the saving identification information; and means for rewriting the saving identification information attached to the character string into the editing identification information.

According to the above-described arrangements, it is possible to identify as to whether the inputted character string is in the process of editing or in the process of registering and saving by attaching either the editing identification information or the saving identification information to the inputted character string. It is also possible to rewrite the identification information attached to the character string as appropriate in either the editing identification information rewriting step or the saving identification information rewriting step. Therefore, it is possible to store both the character string in the process of editing and the character string in the process of registering and saving into the same storage area. In other words, it is not necessary to store the character string in the process of editing and the character string in the process of registering and saving in different areas. Accordingly, a storage area having a capacity for N pieces of character strings can deal with N pieces of character strings. In this way, it is possible to use the storage area more efficiently than a conventional tape printer.

BRIEF DESCRIPTION OF THE DRAWINGS

FIGS. 2A and 2B are external perspective views concerning the tape printer according to the embodiment of the present invention, in which FIG. 2A is an external perspective view of a tape cartridge and FIG. 2B is an external perspective view of the tape printer when a lid is open;

FIGS. 5A and 5B are explanatory views concerning file registration of text data, in which FIG. 5A is a view showing a flow of operations for file registration and FIG. 5B is an explanatory view showing a processing method of file registration;

FIGS. 6A and 6B are explanatory views concerning file retrieval of the text data, in which FIG. 6A is a view showing a flow of operations for file retrieval and FIG. 6B is an explanatory view showing a processing method of file retrieval;

DESCRIPTION OF THE PREFERRED EMBODIMENTS

Now, a tape printer according to one embodiment of the present invention will be described in detail with reference to the accompanying drawings.

Figure 1:
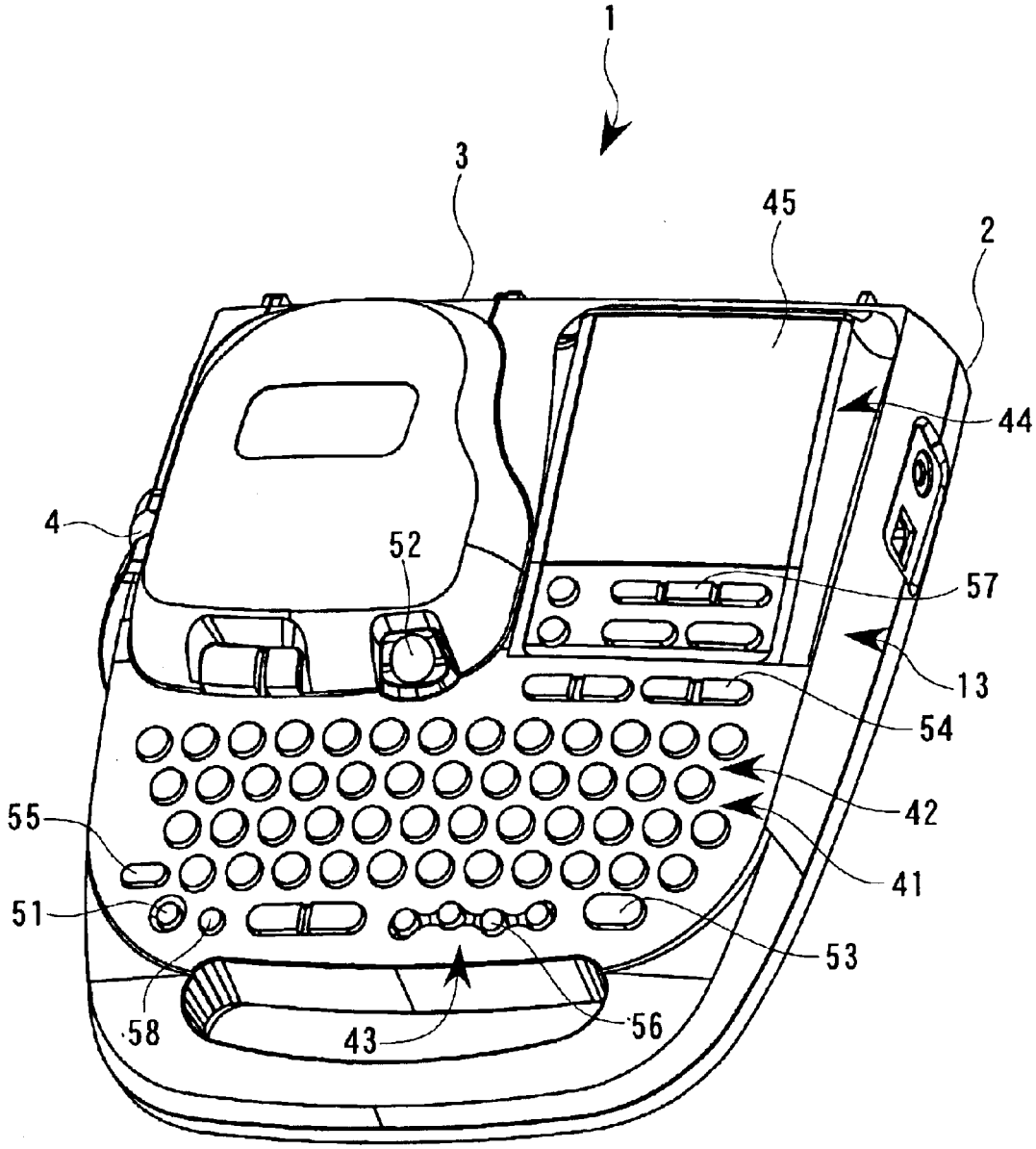
FIG. 1 is an external perspective view of a tape printer according to one embodiment of the present invention.
Figure 2A:
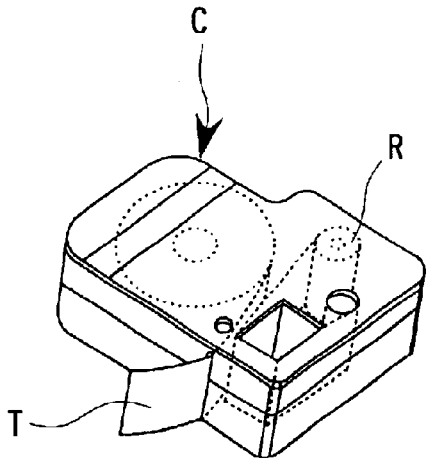
Figure 2B:
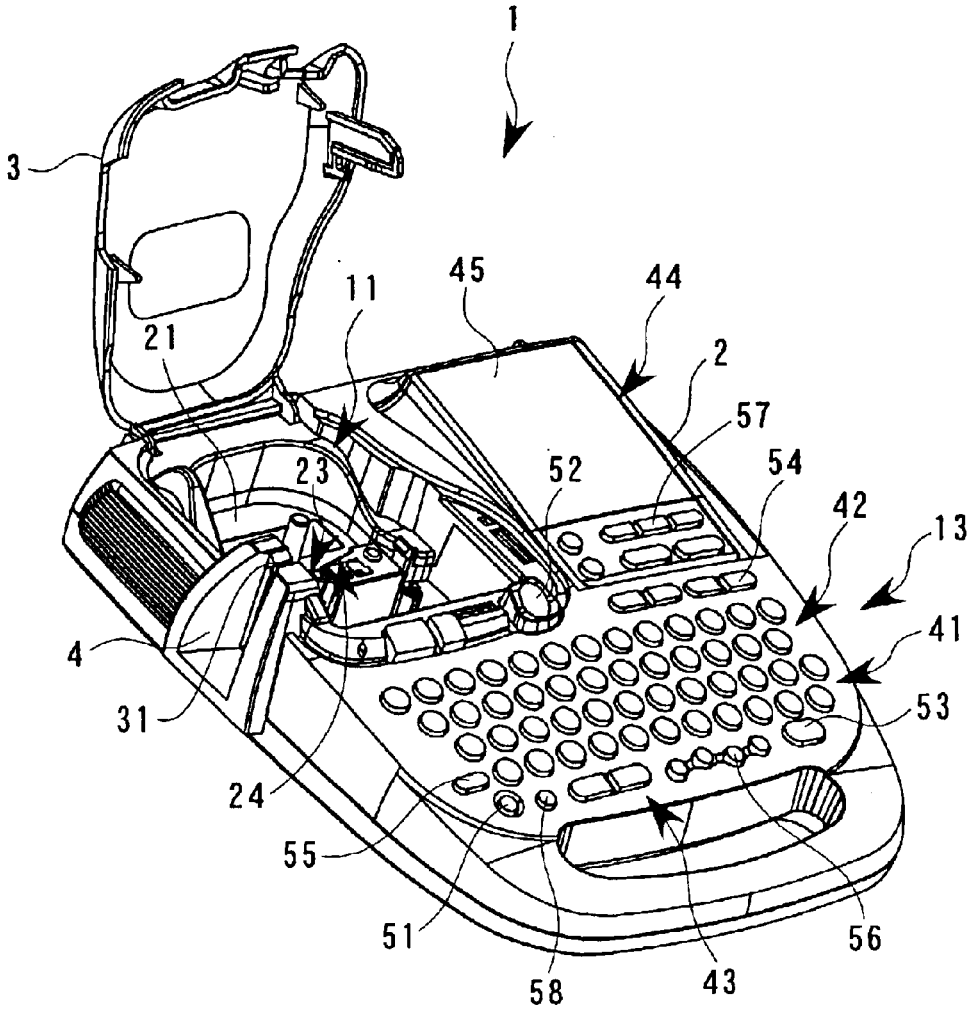

FIG. 1 is an external perspective view of an entire tape printer of this embodiment and FIGS. 2A and 2B are external perspective views of the tape printer of this embodiment showing the state in which a lid of the tape printer is open. As shown in FIG. 1 and FIG. 2B, a tape printer 1 is covered with a cover case 2. A pocket 21 for fitting a tape cartridge C and a lid 3 thereof are provided on the left side at a rear part of an upper surface of the cover case 2. Moreover, a keyboard 41 is provided at a front part of the upper surface of the tape printer 1, and a display 44 is provided on the right side of the lid 3. In addition, a tape discharging port 4 is formed on a left surface of the cover case 2 for discharging a printing tape T printed by the tape printer.

The tape printer 1 prints printing image data such as letters, numbers or symbols based on inputted text data (a character string) by a printing unit 11 disposed inside a pocket 21 while feeding the printing tape T from the tape cartridge C, then sends a printed part out of the tape discharging port 4, and then cut the printing tape T in a given position with a tape cutter 31 provided at the tape discharging port 4 to make a label. The respective parts of the tape printer 1 are controlled by a control unit 15 through various drivers in a drive unit 14 which is described later. The control unit 15 controls the respective parts individually and controls the entire tape printer 1 as well.

As shown in FIG. 2A, the printing tape T is housed in the tape cartridge C together with an ink ribbon R. The printing tape T is subjected to thermal transfer of characters from the ink ribbon R synchronously with drive of a printing head 24 (to be described hereinafter), and then is sent out of the tape cartridge C as appropriate. Moreover, there is provided an adhesive surface covered with release coated paper on the back surface of the printing tape T, so that the printing tape T is capable of being attached or adhered as a label. In addition, various types of printing tapes T in different widths are arranged to be selectable depending on applications.

As shown in FIG. 2B, the printing unit 11 is made up of the pocket 21 for fitting therein the tape cartridge C, a tape feeder 23 for feeding and sending the printing tape T from the tape cartridge C, and the printing head 24 which is covered with a head cover and is formed by a thermal head. When the printing head 24 is thermally driven, characters such as letters are printed on the printing tape T. A tape identification sensor 100 (not illustrated) for detecting the type (width) of the printing tape T is provided in the pocket 21.

An operation unit 13 includes the keyboard 41 composed of various keys, and the display 44 for displaying printing information. In the keyboard 41, there are arranged a letter key group 42 which includes an alphabet key group, a symbol key group, a number key group, an external character key group for retrieving and selecting external characters, and the like. In addition, a functional key group 43 for designating various actions, and the like are also arranged in the keyboard 41.

The functional key group 43 includes: a power key 51; a print key 52 for instructing a printing operation; a select key 53 for settling data upon text input, starting a new line and instructing selection of various modes in a select screen; a cancel key 54 for canceling various instructions; a shift key 55 for changing functions of the respective keys and the like; and four cursor keys 56 (56U, 56D, 56L, 56R) for moving a cursor or a display range of a display screen 45. Moreover, the functional key group 43 also includes: a file key 57 for causing menu display of a file menu; an image key 58 for switching an input screen and a display screen of the printing image data alternately; and the like.

The display 44 has a rectangular shape with dimensions of 4 cm deep×6 cm wide, and includes the display screen 45 capable of displaying 32 dots×64 dots display image data, and 18 indicators (not shown) for displaying various setting conditions. Moreover, the display 44 is used when a user inputs data, various instructions and the like by using the keyboard 41 or when the user creates or edits the printing image data such as character string image data.

Figure 3:
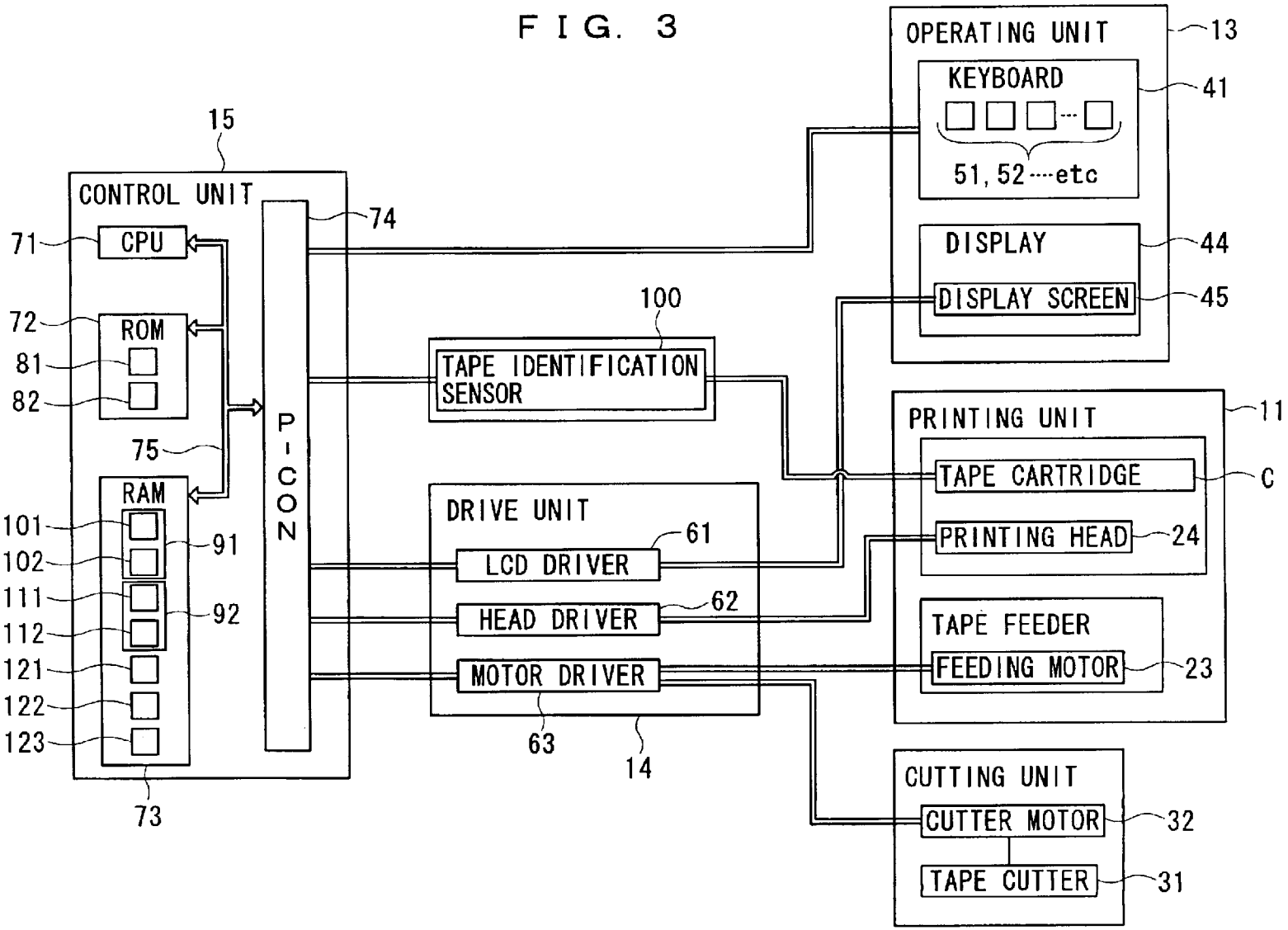
FIG. 3 is a block diagram showing a control system of the tape printer of the embodiment.

As shown in FIG. 3, the drive unit 14 drives the respective parts based on control signals outputted from the control unit 15. The drive unit 14 includes: a display driver 61 for driving the display 44; a head driver 62 for driving the printing head 24; and a motor driver 63 for driving various motors such as a cutter motor 32 for operating the tape cutter 31.

The control unit 15 is made up of digital integrated circuits. As shown in FIG. 3, a central processing unit (CPU) 71, a read-only memory (ROM) 72, a random access memory (RAM) 73, and a peripheral control circuit (P-CON) 74 are connected to one another by an internal bus 75. The ROM 72 includes a control program area 81 for storing control programs to be processed by the CPU 71, and a control data area 82 for storing font data prepared for the tape printer 1, such as letters, symbols, figures and the like, and for storing control data such as a color conversion table or a font modification table.

The RAM 73 receives electric supply by a back-up circuit (not shown) so that stored data therein are retained if power is temporarily shut down as a result of operation of the power key 51 and the like. Moreover, the RAM 73 includes: a registration sub-area 101 for storing (registering and saving) text data to be used by the user later, such as various register groups and the letters inputted by the user with the keyboard 41; an editing operation sub-area 102 for storing text data in the process of editing on the display screen 45;

and a display image data storage area 103 for storing display image data on the display screen 45, collectively referred to as an editing storage area 91 to be used for editing, registering and saving the inputted text data. The editing storage area 91 is used not only as a storage area for storing the text data but also as a storage area for storing data necessary for editing, registering and saving the text data, such as outer frame data attached to the text data, character size data of the text data, or the like. Moreover, each of the registration sub-area 101 and the editing operation sub-area 102 in the editing storage area 91 is provided with a storage area adequate for storing just one piece of text data.

Furthermore, the RAM 73 also includes: a printing image data storage area for storing printing image data developed based on the inputted text data and the like; and a printing position storage area for storing a printing position of the printing image data with respect to a printing tape A, collectively referred to as a printing storage area to be used in the event of printing. In addition, the RAM 73 also includes a pictorial registering image data area, a printing history data area, and a buffer area for various other conversions such as a color conversion, and the like, which are collectively used as an operation area for control processing.

A logic circuit for supplementing functions of the CPU 71 and for handling interface signals with peripheral circuits is built in the P-CON 74. The P-CON 74 is connected to various sensors and the keyboard 41. Accordingly, the P-CON 74 takes various detection signals, various data and various instructions being inputted from the keyboard 41 into the internal bus 75. The P-CON 74 further outputs the data and control signals, which are outputted from the CPU 71 or the like to the internal bus 75, toward the drive unit 14.

The CPU 71 processes various detection signals, various data, and various instructions inputted via the P-CON 74 in accordance with the control programs in the ROM 72, and then outputs the control signals to the drive unit 14 via the P-CON 74. In this way, the CPU 71 controls the whole tape printer 1.

Figure 4:
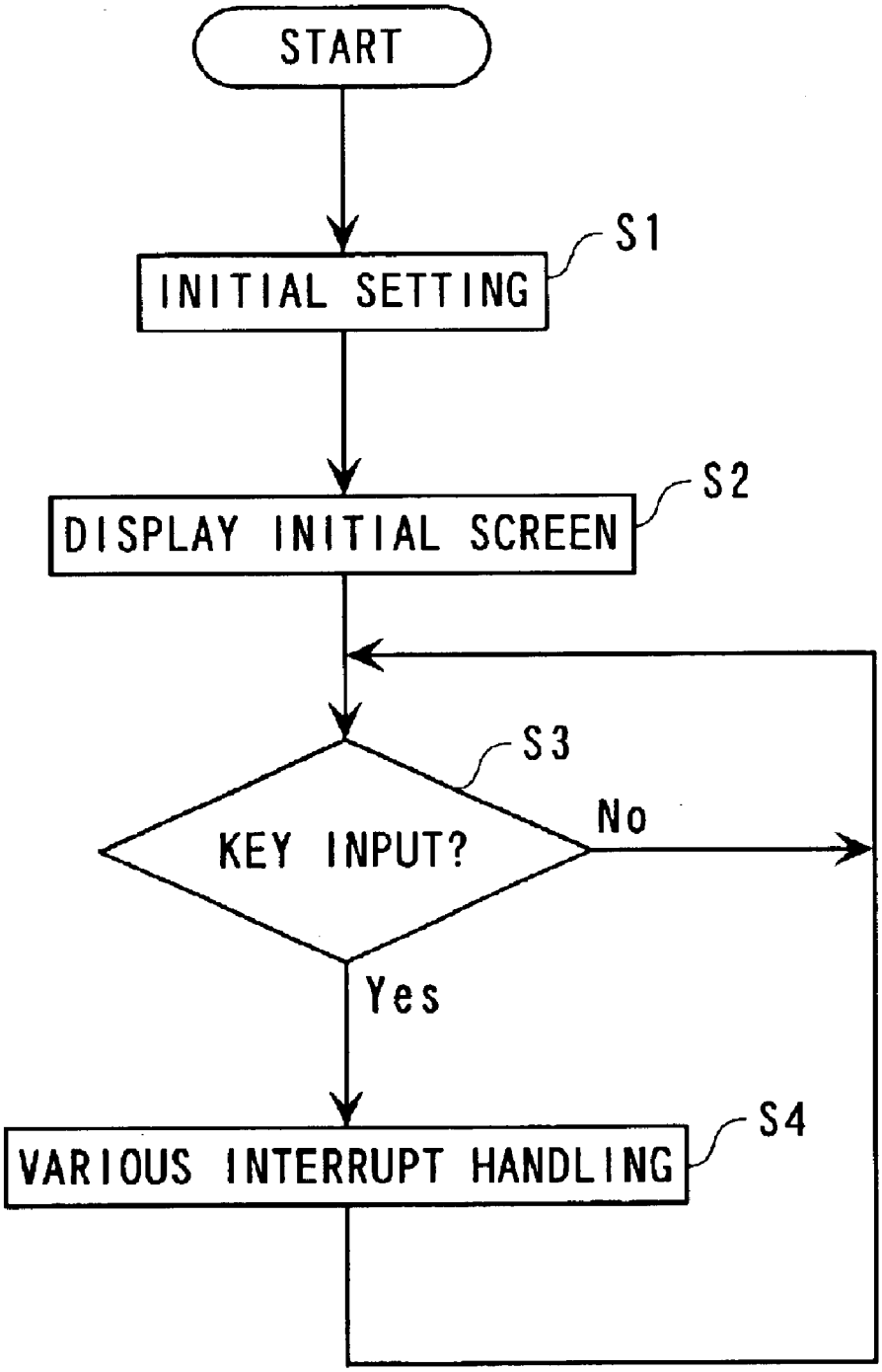
FIG. 4 is a flowchart showing the entirety of control in the tape printer of the embodiment with conceptual processes.

Control processing of the tape printer 1 is mainly performed by interrupt handling. The user is entitled to freely select operation procedures for printing as long as creation or printing of the printing image data is ready. The entire processing flow of controlling the tape printer 1 will now be described with reference to FIG. 4. At the start of the processing by turning on the power or the like, initial setting is performed first to set the tape printer 1 back to a required initial state (S1). Then, an initial screen is displayed on the display screen (S2). When the initial screen display is completed and key input interruption is permitted, a key input interruption stand-by condition is established (S3: No) and key input becomes feasible. When key input interruption occurs by key inputting (S3: Yes), the processing moves to interrupt handling (S4). When interrupt handling is completed, the key input interruption stand-by condition is reestablished (S3: No). The branch of judging (S3) as to whether or not key input has taken place, and various interrupt handling (S4) are the processing that are conceptually indicated.

This tape printer 1 can register and save one piece of the inputted text data (the character string) as a file, and a "file" menu for managing the file is provided therein. The "file" menu is provided with a menu item "register" for registering the text data into the file, a menu item "retrieve" for retrieving the text data registered and saved in the file, and a menu item "interchange" for interchanging the text data in the process of editing and the text data registered and saved therein. Processing for interchanging the text data by use of the menu item "interchange" constitutes a characteristic of this embodiment. The characteristic here relies on a method of using the storage area in the event of the interchanging processing. Selection of a menu item is performed by operating the cursor keys 56U and 56D, then highlighting the selected menu item to establish a tentatively definite input state, and then pressing the select key 53 down. In addition, it is also possible to display the menu items on the same level serially by operating the cursor keys 56U and 56D.

Figure 5A:
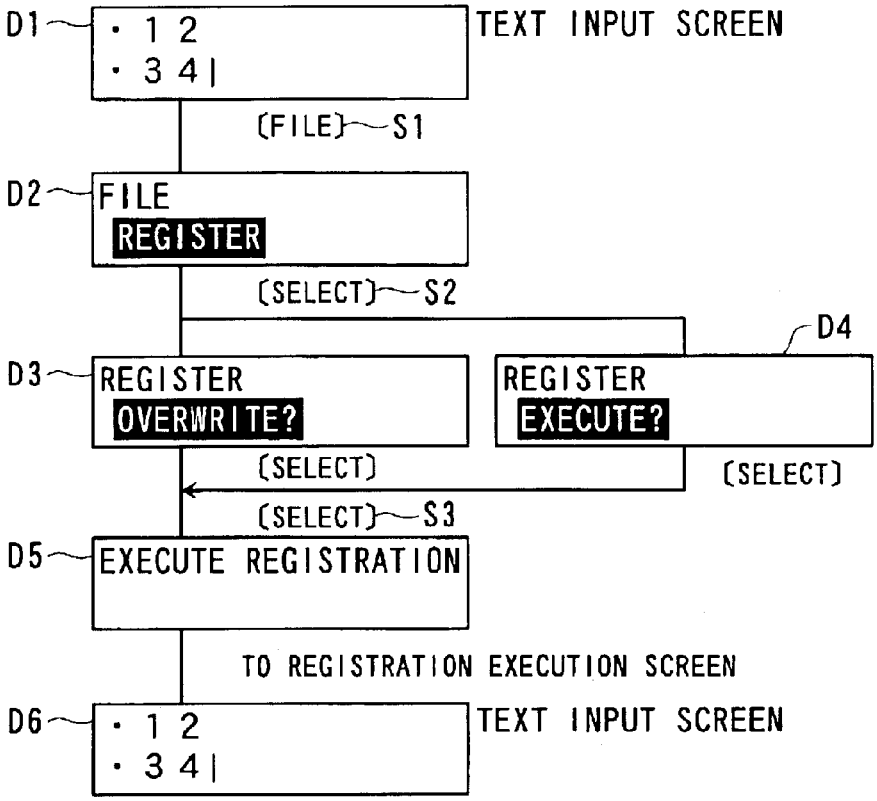

Description will be made about the respective menu items on the "file" menu. The menu item "register" is used to register and save the text data on a text input screen as a file. An operation flow of file registration will now be described. As shown in FIG. 5A, if the file key 57 is pressed down (S1) while a string "1234" is displayed on the text input screen (D1) as text data $A_1$, the menu item "register" on the file menu is highlighted (D2). Then, if the select key 53 is pressed down (S2), a confirmation screen is displayed before execution of file registration. To be more precise, if there is a previously registered file, the description "overwrite?" is highlighted (D3); meanwhile, if there is not a previously registered file, the description "execute?" is highlighted (D4). When the select key 53 is pressed down on the confirmation screen (S3), the processing for file registration of the text file $A_1$ is started and a registration execution screen (D5) is displayed simultaneously. When the processing for registration of the text data $A_1$ is completed, the text input screen is displayed again (D6). If the cursor keys 56U and 56D are operated when the menu item "register" is highlighted, it is possible to highlight the menu items "retrieve" and "interchange" serially.

Figure 5B:
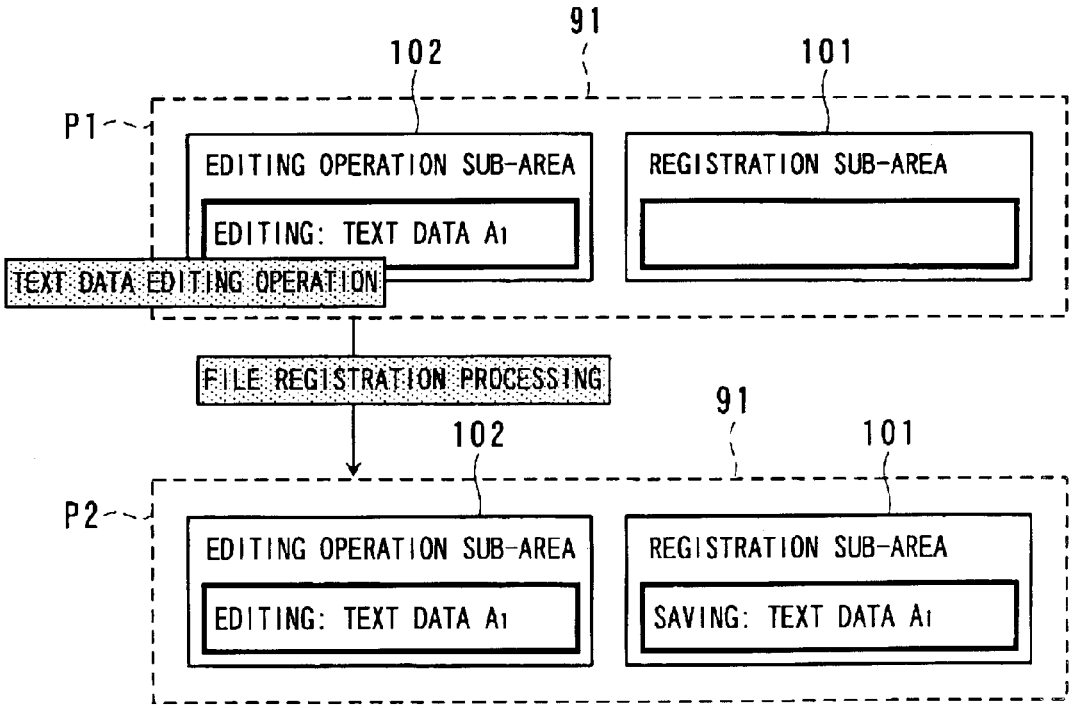

Description will now be made about a processing method for file registration of the text data with reference to FIG. 5B. FIG. 5B schematically shows the editing storage area 91, and the text data $A_1$ in the process of editing is stored in the editing operation sub-area 102 (P1). When the processing for file registration of the text data $A_1$ is started after the step S3, the text data $A_1$ stored in the editing operation sub-area 102 are stored in the registration sub-area 101 (P2). At this time, the text data $A_1$ stored in the editing operation sub-area 102 remain stored in the editing operation sub-area 102. Therefore, when the processing for file registration is completed, the text data $A_1$ are displayed on the input screen again and becomes editable.

Figure 6A:
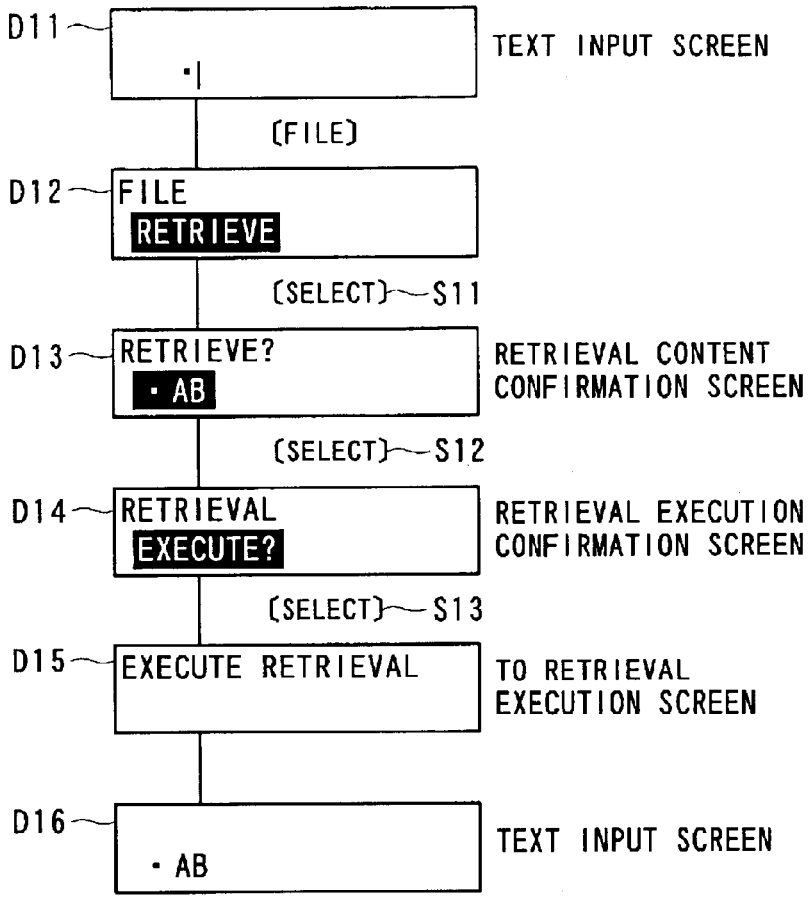
Figure 6B:
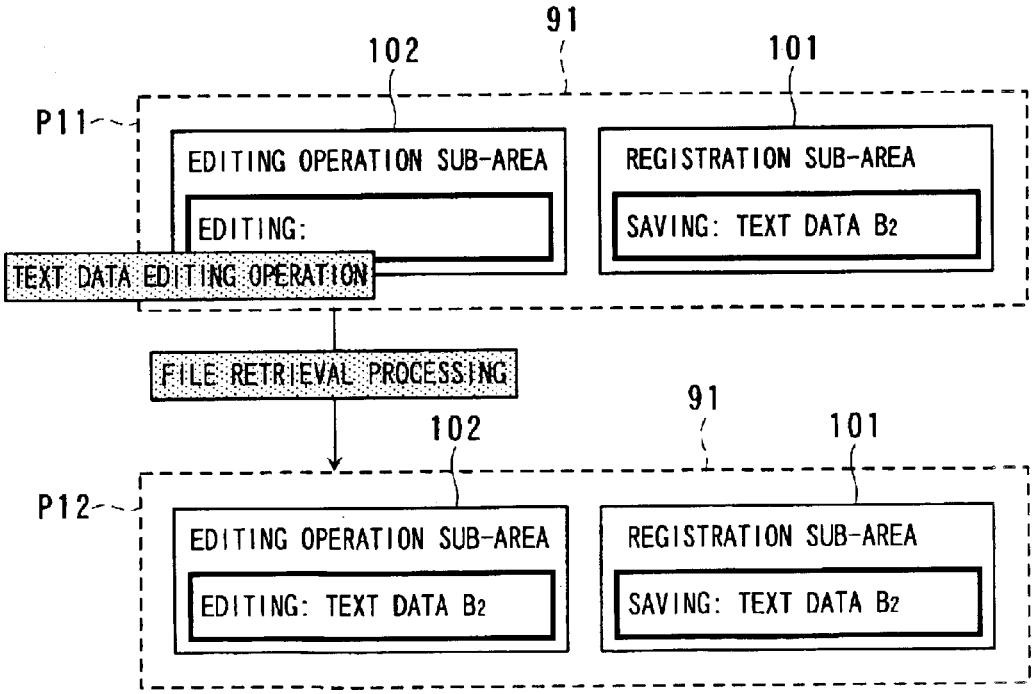

The menu item "retrieve" retrieves the text data registered and saved in the registration sub-area 101 as a file onto the text input screen as editable text data. With reference to FIGS. 6A and 6B, an operation for file retrieval will be described based on the assumption that text data $B_2$ (a string "ABCD") are saved in the registration sub-area 101. When the file key 57 is pressed down on a text input screen (D11) and the menu item "retrieve" is thereby selected (D12, S11), a retrieval content confirmation screen is displayed for confirmation of executing retrieval (D13). Part of the contents of the text data $B_2$ for retrieval is highlighted in the retrieval content confirmation screen. In this state, when selection is made by using the select key 53 (S12), a retrieval execution confirmation screen is subsequently displayed, and the description "execute?" is highlighted (D14). Then, upon pressing the select key 53 down (S13), a retrieval execution screen is displayed (D15) and file retrieval processing is started simultaneously, whereby the text data $B_2$ are displayed on the text input screen (D16).

If the file retrieval processing is started when the text data $B_2$ are registered and saved in the registration sub-area 101 (P11), the text data registered and saved in the registration sub-area 101 are stored in the editing operation sub-area 102 (P12). Accordingly, the text data $B_2$ are displayed on the text input screen and become editable. Meanwhile, if the menu item "retrieve" is selected when text data $B_1$ are displayed on the text input screen, in other words, when the text data $B_1$ are stored in the editing operation sub-area 102, then the text data $B_2$ are stored (overwritten) in the editing operation sub-area 102 which originally stores the text data $B_1$. Accordingly, the text data $B_1$ originally stored in the editing operation sub-area 102 are deleted. In this way, the menu item "retrieve" retrieves the text data which have been retrieved and saved before onto the input screen, and also deletes the text data which are on the input screen at that time.

Figure 7:
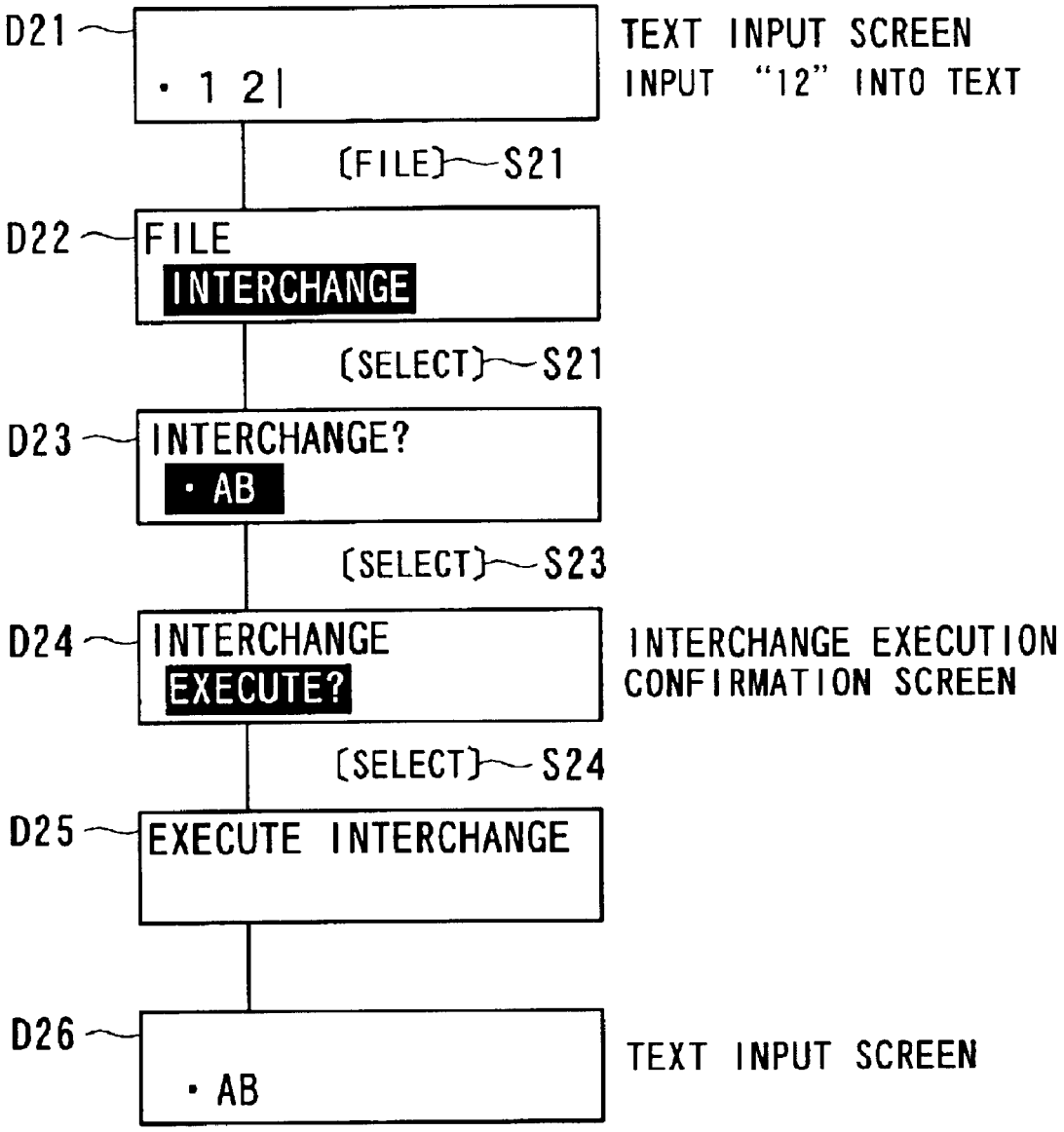
FIG. 7 is a view showing a flow of operations for file interchange of the text data.

On the contrary, the menu item "interchange" retrieves the text data which are previously registered and saved onto the input screen, and simultaneously registers and saves the text data currently on the input screen as a file. The function of the menu item "interchange" is different from the function of the menu item "retrieve" in that the text data currently on the input screen are registered and saved as a file. An operation for file interchange will now be described based on the assumption that text data $C_1$ (a string "12") are stored in the editing operation sub-area 102 and text data $C_2$ (a string "ABCD") are stored in the registration sub-area 101, respectively. As shown in FIG. 7, if the file key 57 is pressed down (S21) when the text data $C_1$ are displayed on the text input screen (D21) and the menu item "interchange" is selected (D22, S22), the description "interchange?" is displayed on an interchange content confirmation screen and part of the contents of the text data $C_2$ previously registered and saved is highlighted (D23). Thereafter, when the select key 53 is pressed down (S23), an interchange execution confirmation screen is displayed (D24). If the select key 53 is pressed down again (S24), an interchange execution screen is displayed (D25) and processing for file interchange is started simultaneously, whereby the text data $C_2$ are displayed on the input screen (D26) and the text data $C_1$ are registered and saved as a file at the same time.

In case where the text data in process of editing and the registered and the saved text data are stored in different areas as described in this embodiment, the processing for file interchange requires the storage area sufficient to store at least three pieces of text data. However, the tape printer 1 of this embodiment has the storage area within the editing storage area 91, in aggregate of the storage areas in the editing operation sub-area 102 and the registration 101, which is adequate for storing only two pieces of text data. Therefore, the tape printer 1 of this embodiment achieves file interchange by securing a temporary area for temporarily storing the text data only in the event of performing the processing for file interchange.

Figure 8:
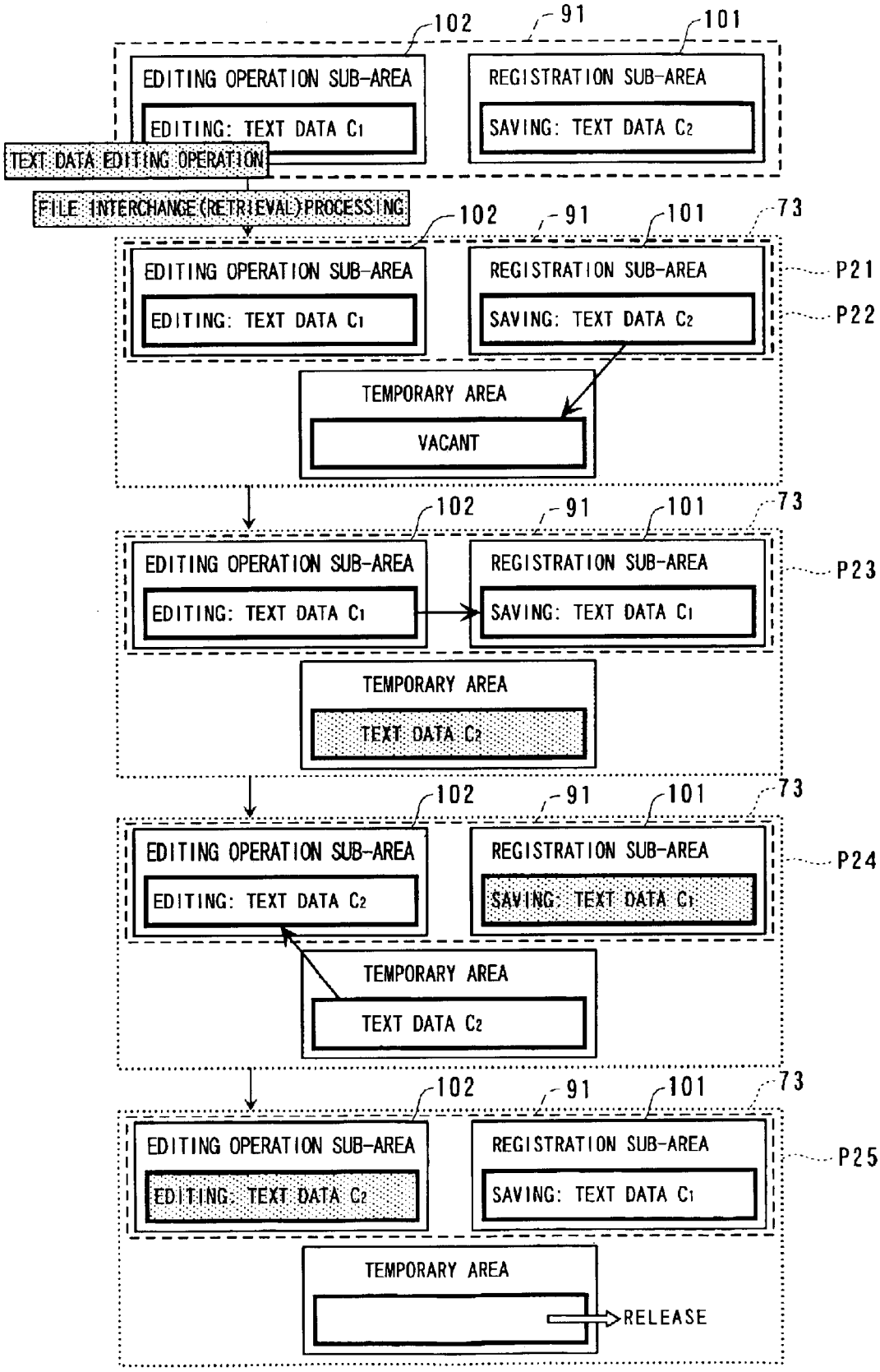
FIG. 8 is an explanatory view showing one example of a processing method of file interchange of the text data.

The processing for file interchange in the tape printer 1 of this embodiment will now be described concretely with reference to FIG. 8. When the processing for file interchange is started, a temporary area, which is a storage area for temporarily storing the text data, is secured from the printing image data storage area or the printing position storage area in the printing storage area (P21). Next, the text data $C_2$ stored in the registration sub-area 101 are stored into the temporary area (P22), and then the text data $C_1$ stored in the editing operation sub-area 102 are stored into the registration sub-area 101 (P23). Thereafter, the text data $C_2$ stored in the temporary area are stored into the editing operation sub-area 102 (P24). In this way, the text data $C_1$ originally stored in the editing operation sub-area 102 and the text data $C_2$ originally stored in the registration sub-area 101 are interchanged. Subsequently, the temporary area storing the text data $C_2$ is released (P25), and the storage area secured as the temporary area is secured again as the printing storage area.

The text data to be stored in the temporary area may be either the text data $C_2$ in the registration sub-area 101 or the text data $C_1$ in the editing operation sub-area 102. In other words, the text data $C_1$ stored in the editing operation sub-area 102 and the text data $C_2$ stored in the registration sub-area 101 may be interchanged by storing the text data $C_1$ into the temporary area, then storing the text data $C_2$ into the editing operation sub-area 102, and then storing the text data $C_1$ stored in the temporary area into the registration sub-area 101. Although the temporary area is secured from the printing storage area in this embodiment, the temporary area is used only temporarily in the event of the processing for file interchange. Therefore, it is also possible to use a storage area other than the printing storage area as appropriate if such a storage area is not used during an editing operation.

As described above, the characteristic of this embodiment is to secure the temporary area, which is the storage area temporarily provided, from the storage area not used during the editing operation upon the processing for file interchange. Moreover, according to the method of processing for file interchange, file interchange becomes feasible with the tape printer of this embodiment which can store only two pieces of text data within the editing storage area, by effectively using the storage area which is not used during the editing operation. As a result, the tape printer can deal with two pieces of text data practically. Even if the tape printer can store more than two pieces of text data within the editing storage area 91, such as in the case where a plurality of text data can be stored in the registration sub-area 101, the above-described method of processing for file interchange can eliminate the need of constantly securing the storage area within the editing storage area 91, which may be required for the processing for file interchange. Accordingly, the method can provide effective use of the storage area. Moreover, as the file interchange between the text data in process of editing and the text data in process of registering and saving becomes feasible, it is possible to retrieve the text data in the process of registering and saving without carrying out a saving operation of the text data in the process of editing. In this way, the method can enhance operability of a user.

In addition, there is another method of processing for text interchange which is effective for economizing a storage area required for text data exchange. Specifically, the method comprises the steps of: attaching an identification flag to inputted text data, storing text data in the process of editing and text data in the process of registering and saving not into different areas but into the same area, and rewriting the flag upon interchanging the text data. To be more precise, neither the registration sub-area 101 nor the editing operation sub-area 102 is provided in the editing storage area 91. Instead, an edit flag it attached to the text data in the process of editing, and a save flag is attached to the text data in the process of registering and saving. Then, these text data are stored in the editing storage area 91 together. Moreover, in the event of interchanging the text data, the flags are rewritten as appropriate to as to effectuate the interchange between the text data in the process of editing and the text data in the process of registering and saving.

Figure 9:
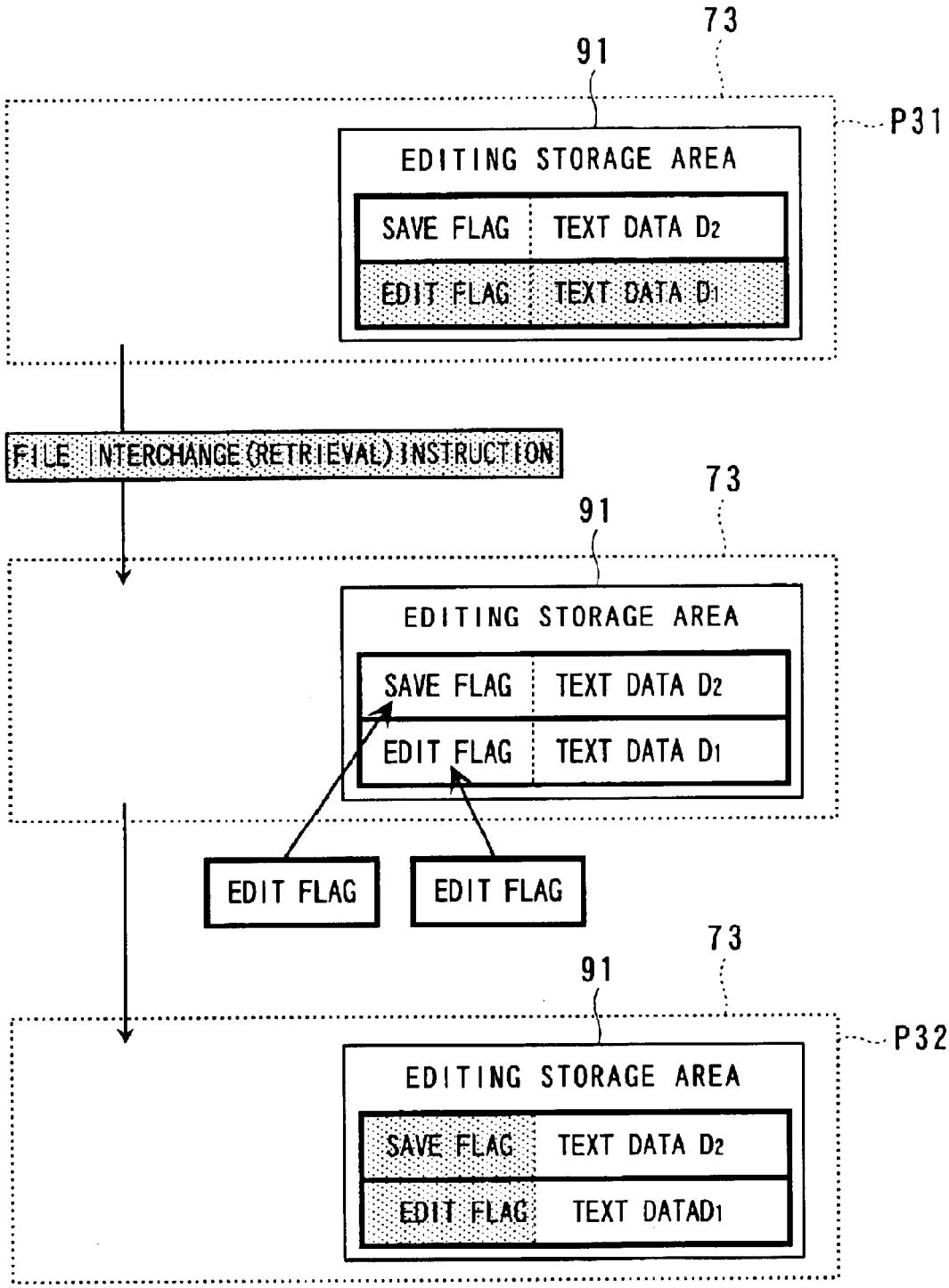
FIG. 9 is an explanatory view showing another example of the processing method of file interchange of the text data.

Description will now be made about the processing for file interchange of the text data attaching the identification flags, with reference to FIG. 9. Text data $D_2$ in the process of registering and saving and text data $D_1$ in the process of editing are stored in the editing storage area 91. Now, the text data $D_2$ in the process of registering and saving are saved with attachment of a save flag thereto. Meanwhile, an edit flag is attached to the text data $D_1$ in the process of editing, and the text data $D_1$ are set editable on the text input screen (P31).

When the processing for interchanging the text data $D_1$ in the process of editing and the text data $D_2$ in the process of registering and saving is started, the edit flag of the text data $D_1$ is rewritten into the save flag, meanwhile, the save flag of the text data $D_2$ is rewritten into the edit flag (P32). Then, the text data D2 with attachment of the edit flag are displayed on the text input screen and becomes editable. Herein, either the edit flag or the save flag may be rewritten beforehand. Meanwhile, if the tape printer can save a plurality of text data as files, then the identification flags may bear information indicating file numbers, whereby the text data subject to interchange are rendered identifiable.

In this way, if the identification flags are attached to the inputted text data and the text data in the process of editing and the text data in the process of registering and saving are stored together in the same storage area, it is possible to carry out file interchange only by rewriting the identification flags in the course of the processing for file interchange. Accordingly, it is not necessary to store the text data into another area during the processing for file interchange, so that the storage area for interchanging the text data can be curtailed.

As described above, according to the method of processing a character in a tape printer as well as a tape printer adopting the method of the present invention, the text data in the process of editing and the text data in the process of saving can be interchanged by use of the temporary area secured outside the editing storage area. Therefore, it is not necessary to constantly secure the storage area within the editing storage area for interchanging the text data, so that the storage area can be utilized effectively and efficiently.

Moreover, the text data in the process of editing and the text data in the process of registering and saving can be stored into the same storage area (the editing storage area) by attaching editing identification information to the inputted text data and thereby rendering the text data in the process of editing and the text data in the process of registering and saving identifiable. In this way, it is possible to economize the storage area upon interchanging the text data.

What is claimed is:

1. A method of processing a character in a tape printer, said printer comprising an editing storage area including an editing operation sub-area for editing an inputted character string and a registration sub-area for registering and saving a character string to be used later, the method comprising:

a first step of securing a temporary area for temporarily storing a character string outside the editing storage area;

a second step of storing a character string stored in the editing operation sub-area into the temporary area after the first step;

a third step of storing a character string stored in the registration sub-area into the editing operation sub-area after the second step;

a fourth step of storing the character string stored in the temporary area into the registration sub-area after the third step; and a fifth step of releasing the temporary area after the fourth step.

2. The method according to claim 1, wherein the temporary area is secured from a printing storage area which is a storage area for printing the character string.

3. A method of processing a character in a tape printer, said printer comprising an editing storage area including an editing operation sub-area for editing an inputted character string and a registration sub-area for registering and saving a character string to be used later, the method comprising:

a first step of securing a temporary area for temporarily storing a character string;

a second step of storing a character string stored in the registration sub-area into the temporary area after the first step;

a third step of storing a character string stored in the editing operation sub-area into the registration sub-area after the second step;

a fourth step of storing the character string stored in the temporary area into the editing operation sub-area after the third step; and a fifth step of releasing the temporary area after the fourth step.

4. The method according to claim 3, wherein the temporary area is secured from a printing storage area which is a storage area for printing the character string.

5. A tape printer having an editing storage area including an editing operation sub-area for editing an inputted character string and a registration sub-area for registering and saving a character string to be used later, the tape printer comprising:

means for securing a temporary area for temporarily storing a character string outside the editing storage area;

means for storing a character string stored in the editing operation sub-area into the temporary area;

means for storing a character string stored in the registration sub-area into the editing operation sub-area;

means for storing the character string stored in the temporary area into the registration sub-area; and means for releasing the temporary area.

6. The tape printer according to any one of claims 5, wherein the temporary area is secured from a printing storage area which is a storage area for printing the character strings.

7. A tape printer having an editing storage area including an editing operation sub-area for editing an inputted character string and a registration sub-area for registering and saving a character string to be used later, the tape printer comprising:

means for securing a temporary area for temporarily storing a character string;

means for storing a character string stored in the registration sub-area into the temporary area;

means for storing a character string stored in the editing operation sub-area into the registration sub-area;

means for storing the character string stored in the temporary area into the editing operation sub-area; and means for releasing the temporary area.

8. The tape printer according to any one of claims 7, wherein the temporary area is secured from a printing storage area which is a storage area for printing the character strings.

* * * * *